US006007368A

United States Patent [19]

Lorenz et al.

[11] Patent Number: 6,007,368

[45] Date of Patent: Dec. 28, 1999

[54] TELECOMMUNICATIONS CONNECTOR WITH IMPROVED CROSSTALK REDUCTION

[75] Inventors: Alan S. Lorenz, Everett; Franklin C. Marti, Lynnwood; Clifford R. Curry, Seattle, all of Wash.

[73] Assignee: Leviton Manufacturing Company, Inc., Little Neck, N.Y.

[21] Appl. No.: 08/972,794

[22] Filed: Nov. 18, 1997

[51] Int. Cl.[6] ..... H01R 4/24

[52] U.S. Cl. ..... 439/418; 439/941

[58] Field of Search ..... 439/418, 676, 439/941, 344

[56] References Cited

U.S. PATENT DOCUMENTS

| | | | |
|---|---|---|---|
| 5,226,835 | 7/1993 | Baker, III et al. | 439/941 |
| 5,310,363 | 5/1994 | Brownell et al. | 439/941 |
| 5,350,324 | 9/1994 | Builbert | 439/941 |
| 5,362,257 | 11/1994 | Neal et al. | 439/941 |
| 5,626,497 | 5/1997 | Bouchan et al. | 439/941 |
| 5,779,503 | 7/1998 | Tremblay et al. | 439/941 |

*Primary Examiner*—Gary F. Paumen
*Attorney, Agent, or Firm*—Seed and Berry LLP

[57] ABSTRACT

A telecommunications connector includes a body having a first end to mate with a mating connector and a second end having an aperture. A plurality of connector elements have a connection portion to make electrical contact with individual wires from wire cables. In an exemplary embodiment, the individual wires are in the form of twisted pair cables. The connector elements also include a terminating portion to make electrical contact with the mating connector, and an elongated intermediate portion coupling the corresponding connection and terminating portions. The elongated intermediate portion minimizes the overall surface area of the electrical contacts thereby reducing the capacitance between individual ones of the connector elements. In addition, the connector elements are mounted in a low dielectric constant material to further reduce capacitance between individual ones of the connector elements. The connection portions of the connector elements are arranged in a first sequence to permit the twisted pair cables to remain twisted throughout the body of the connector to an area proximate the connection portion of the connector elements. The terminating portions of the connector elements are in a sequential arrangement different from the sequential arrangement of the connection portions of the connector elements to maintain an industry standard arrangement. The elongated intermediate portions of at least some of the connector elements extend laterally and cross over other connector elements to permit the terminating portions of the connector elements to conform to industry standards while permitting the twisted pair cables to remain in a twisted configuration for the length of the cable.

32 Claims, 5 Drawing Sheets

TELECOMMUNICATIONS CONNECTOR WITH IMPROVED CROSSTALK REDUCTION

TECHNICAL FIELD

The present invention is directed to telecommunications connectors, and, more specifically, to a telecommunications connector with improved crosstalk reduction.

BACKGROUND OF THE INVENTION

The widespread use of telecommunications devices has also spurred the development of telecommunications connectors. Initially, telecommunications devices such as telephones, computer terminals, and the like were hard-wired. For example, the wire cable for a telephone was coupled directly through a hole in a wall plate to electrical terminals.

Modem telephone connectors use an industry standard receptacle mounted in the wall and a mating industry standard plug at the end of a telephone cord. The use of industry standard connectors permits the convenient installation of telephones. Similarly, industry standard connectors have been developed for other telecommunications devices such as computers. For example, a personal computer may be coupled to a local area network (LAN) via a telecommunications connector similar to those used with telephones.

The use of telecommunications connectors with telephones does not result in the degradation of signal quality because telephones typically have limited bandwidth. However, high-speed telecommunications devices, such as computers, can suffer significant degradation of signal quality as a result of telecommunications connectors. Therefore, it can be appreciated that there is a significant need for a telecommunications connector that minimizes degradation of signal quality. The present invention offers this and other advantages as will be apparent from the following detailed description and accompanying figures.

SUMMARY OF THE INVENTION

The present invention is directed to a telecommunications connector. In an exemplary embodiment, the telecommunications connector is configured to receive a plurality of electrical conductors in an electrical cable and to mate with a mating connector. The connector assembly comprises a body and a plurality of connector elements retained within the body. Each of the plurality of connector elements has a connection portion for contacting one of the plurality of electrical conductors and a terminating portion for making electrical contact with the mating connector when mated therewith. The connection portion and the terminating portion are coupled together by an elongated arm projecting between the connection portion and the terminating portion.

In one embodiment, the connection portion and the terminating portion have opposing surfaces to define an area. The elongated arm has a second area less than the area between the connection portion and the terminating portion.

In an exemplary embodiment, the body is made with a material having a dielectric constant less than 2.8. The body may be manufactured with a polymethyl pentene material.

In one embodiment, the connection portions are substantially parallel to each other and the terminating portions are substantially parallel to each other with at least two of the elongated arms crossing over each other within the body. In an exemplary embodiment, the two elongated arms cross over each other at a substantially right angle.

The connector assembly may also include a ferrite member positioned within the body containing a plurality of spaced-apart passageways. The passageways are each sized to receive at least one conductor of a different one of twisted pair conductors.

DETAILED DESCRIPTION OF THE INVENTION

Figure 1A:
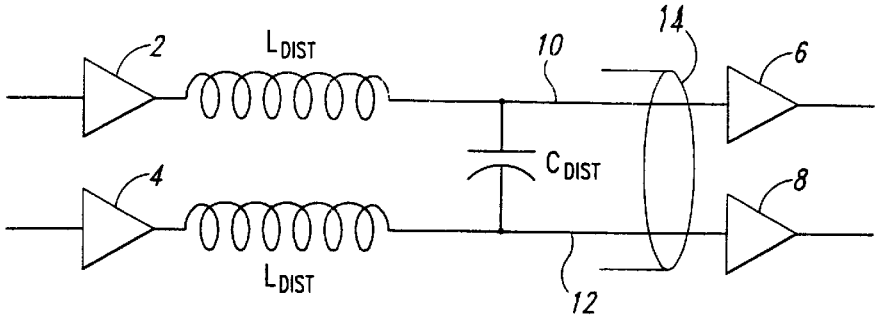
Fig. 1A (Prior Art)
FIG. 1A is a schematic diagram illustrating a conventional telecommunications transmission system.

Telecommunications connectors offer easy and reliable connections for a variety of telecommunications devices. A conventional telecommunications transmission system is illustrated in the schematic diagram of FIG. 1A. The transmission system includes line drivers 2 and 4 and corresponding line receivers 6 and 8. A wire conductor 10 connects the line driver 2 to the line receiver 6. A wire conductor 12 connects the line driver 4 to the line receiver 8. FIG. 1A illustrates the wire conductors 10 and 12 as single conductors, which are typically bundled together as portions of a cable 14. The wire conductors 10 and 12 are thus parallel to each other for the length of the cable 14. A capacitance $C_{DIST}$ and inductance $L_{DIST}$ are shown in FIG. 1A to model a distributed capacitive and inductive coupling between the wire conductors 10 and 12. A mutual inductance between the two inductances $L_{DIST}$ and the capacitance $C_{DIST}$ contributes to the coupling of electrical signals between the wire conductors 10 and 12. The signal that is coupled capacitively or inductively between conductors is an undesirable signal that may be termed a "leakage" signal or "crosstalk." At low frequencies, such as are typical in a telephone, the crosstalk between the wire conductors 10 and 12, respectively, is minimal because the distributed capacitance $C_{DIST}$ and inductance $L_{DIST}$ provide low coupling at such low frequencies. However, at higher frequencies, the crosstalk between the wire conductors 10 and 12 becomes significant.

Figure 1B:
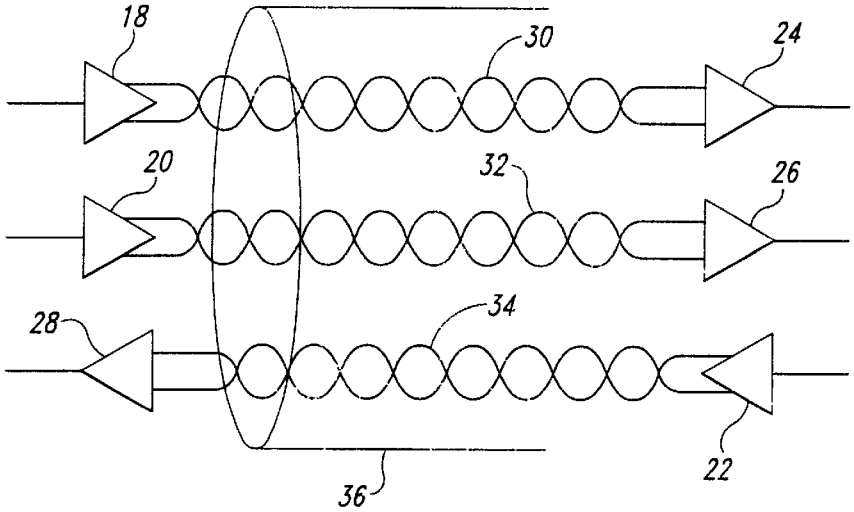
Fig. 1B (Prior Art)
FIG. 1B is a schematic diagram illustrating a conventional technique for transmission of telecommunications signals using differential circuitry and a twisted pair wire cable.

To minimize crosstalk, designers often use twisted pair cables and differential amplifiers, such as illustrated in FIG. 1B. FIG. 1B includes differential line drivers 18, 20 and 22, which are coupled to differential line receivers 24, 26 and 28, respectively. The differential line driver 18 is coupled to the differential line receiver 24 by a twisted pair cable 30. Similarly, a twisted pair cable 32 couples the differential line driver 20 to the differential line receiver 26 and a twisted pair cable 34 couples the differential line driver 22 to the differential line receiver 28. The twisted pair cables 30–34 are typically portions of a cable 36. Each of the twisted pair cables 30–34 may be individually shielded to provide additional protection from crosstalk.

As is known in the art, the differential line receivers 24–28 are designed to reject signals that are present on both conductors of their respective twisted pair cables 30–34. The degree to which the differential line receivers 24–28 can reject these "common mode" signals is indicated by a common mode rejection ratio (CMRR). The system illustrated in FIG. 1B is an improvement over that illustrated in FIG. 1A because crosstalk between the twisted pair cables is canceled out by the CMRR of the differential line receivers. For example, a signal transmitted over the twisted pair cable 32 may be capacitively and inductively coupled to the twisted pair cables 30 and 34. However, the capacitive coupling from the twisted pair cable 32 is substantially equal on both conductors of the twisted pair cable 30. The common mode rejection of the differential line receiver 24 effectively cancels the common mode crosstalk signal. Thus, the twisted pair conductors permit the transmission of data at a significantly higher bandwidth while reducing crosstalk to an acceptable level.

Figure 2:
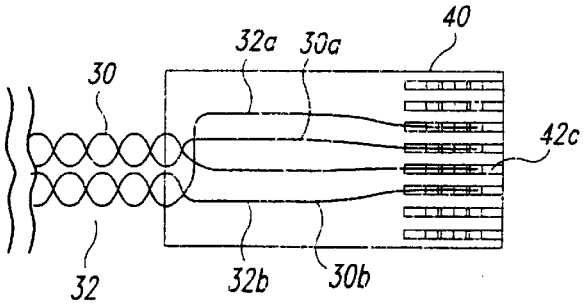
Fig. 2 (Prior Art)
FIG. 2 is a schematic diagram of a conventional telecommunications connector for use with the twisted pair wire cable of FIG. 1B.

The twisted pair conductors are typically terminated in a conventional telecommunications adapter 40 or connector, as illustrated in schematic diagram in FIG. 2. FIG. 2 illustrates an industry standard RJ45 plug, which accommodates four sets of twisted pair cables (i.e., 8 wires). For the sake of simplicity, FIG. 2 only illustrates the connection of the innermost twisted pair cables 30 and 32. The telecommunications connector 40 couples with a conventional compatible mating receptacle (not shown) in a manner well known in the art.

The telecommunications connector 40 includes a plurality of metal contact or connector elements 42 to electrically connect the wire conductors of the twisted pair cables 30 and 32 to the mating receptacle (not shown). The connector elements 42 may be resilient wires or take other conventional forms. The twisted pair cable 30 comprises two individual wires 30*a* and 30*b*, which are untwisted within the telecommunications connector 40 to permit their electrical connection to the corresponding two members of the connector elements 42. Similarly, the twisted pair cable 32 comprises individual wires 32*a* and 32*b*, which are also untwisted within the telecommunications connector 40 to permit their electrical connection to the corresponding two members of the connector elements 42. With the industry standard RJ45 plug, the wires 30*a* and 30*b* of the twisted pair cable 30 are coupled to the innermost pair of the connector elements 42 of the telecommunications connector 40. The wire 32*a* of the twisted pair cable 32 is coupled to a connector element 42 on one side of the wires 30*a* and 30*b* while the wire 32*b* is coupled to a connector element 42 on the opposite side of the wires 30*a* and 30*b*. In this configuration, the untwisted wires 30*a* and 30*b* of the twisted pair cable 30 run inside and generally parallel to the untwisted wires 32*a* and 32*b* of the twisted pair cable 32, as illustrated in FIG. 2.

Because portions of the twisted pair cables 30 and 32 are untwisted within the telecommunications connector 40, the individual wires 30*a* and 30*b* may be differentially exposed to crosstalk from untwisted wires of the twisted pair cable 32 as well as the untwisted wires of the twisted pair cable 34 not illustrated in FIG. 2. That is, the crosstalk from the twisted pair cables 32 and 34 may not occur equally in the individual wires 30*a* and 30*b* in the portion of the twisted pair cable 30 that is untwisted. An industry testing standard, designated as TIA 568A, utilizes an RJ45 plug as a standard plug while testing hardware in a category 5 telecommunications system. A worst case crosstalk condition for crosstalk on an RJ45 plug occurs between the twisted pair cable 30 and the twisted pair cable 32, illustrated in FIG. 2. The untwisted wires 30*a* and 30*b* are coupled to the innermost connector elements 42 of the telecommunications connector 40 while the untwisted wires 32*a* and 32*b* are separated and coupled to connector elements 42 on opposite sides of the innermost connector elements 42 such that the wires 30*a* and 30*b* are located intermediate the wires 32*a* and 32*b*. Measurements of this worst case condition have indicated that the crosstalk between the individual wires of the twisted pair cables 30 and 32 while in an untwisted state result in signal to a crosstalk level of approximately 40 decibels (dB) at 100 megahertz (MHz). Under these circumstances, the differential signal caused by the leakage is significant and cannot be canceled by a differential line receiver. While other wires within the RJ45 plug have a different signal to leakage level ratio, there is still an appreciable differential signal caused by leakage among the various wire conductors in the untwisted portion within the telecommunications connector 40.

Figure 3:
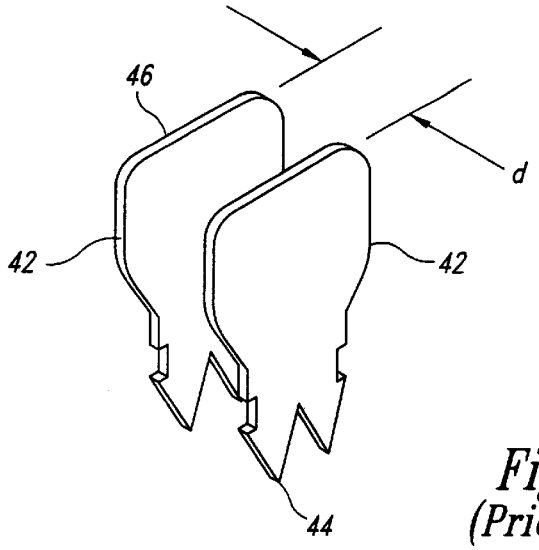
Fig. 3 (Prior Art)
FIG. 3 is a perspective view of connector elements of the conventional telecommunications connector of FIG. 2.

Crosstalk in the conventional telecommunications connector 40 is also caused by the physical construction of the connector elements 42 and the materials used in the construction of the telecommunications connector. FIG. 3 illustrates a pair of the connector elements 42, each having a solid metal piece with a contact surface 44 and a terminal surface 46. The contact surface 44 is used to couple the connector elements 42 to the wire cable while the terminating surface 46 is used to couple the connector elements to the mating connector. The industry standard RJ45 plug contains eight connector elements 42. However, for the sake of simplicity, FIG. 3 illustrates only two connector elements 42. This construction of the connector elements 42 adds to the crosstalk experienced, as will be explained below.

The connector elements 42 are mounted within the telecommunications connector 40 and are arranged parallel to each other and spaced apart at a distance d. Each of the connector elements 42 acts as a plate in a parallel plate capacitor. As is known to those of ordinary skill in the art, the capacitance formed between the connector elements 42 is directly proportional to the surface area of the connector elements and is inversely proportional to the square of the distance d separating the connector elements.

The conventional telecommunications connector 40 is molded from a polycarbonate material, which has a dielectric constant of approximately 3.6. Each of the connector elements 42 is embedded in the polycarbonate material when the telecommunications connector 40 is manufactured. The capacitance between the connector elements 42 is increased through the use of this dielectric material between the connector elements. Therefore, the capacitance between the individual ones of the connector elements 42 is increased by virtue of the parallel surface areas of the connector elements and the high dielectric constant value of the polycarbonate material. Thus, while the telecommunications connector 40 provides a simple and inexpensive connection method, it results in decreased performance due to crosstalk between the conductors within the body of the telecommunications connector and the capacitance coupling between the connector elements themselves.

Figure 4:
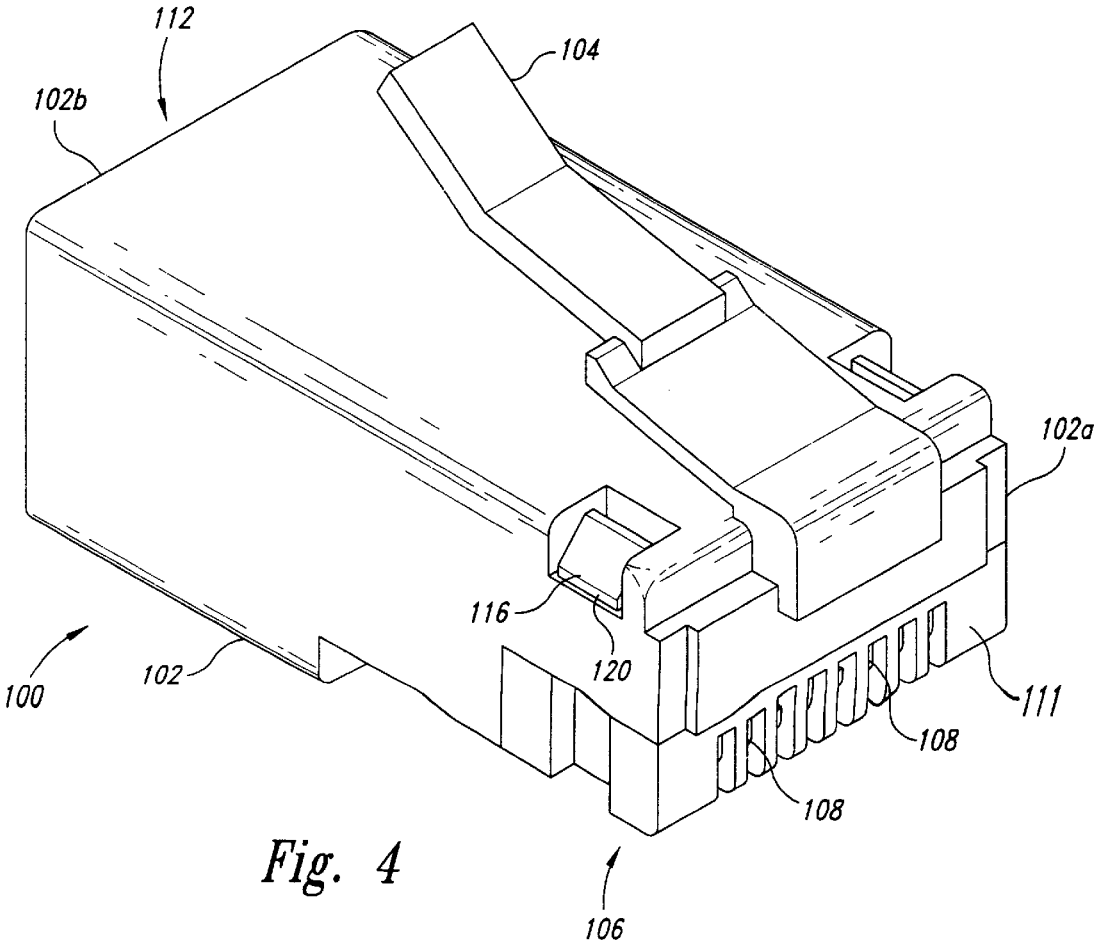
FIG. 4 is a top perspective view of a telecommunications connector of the present invention.
Figure 9:
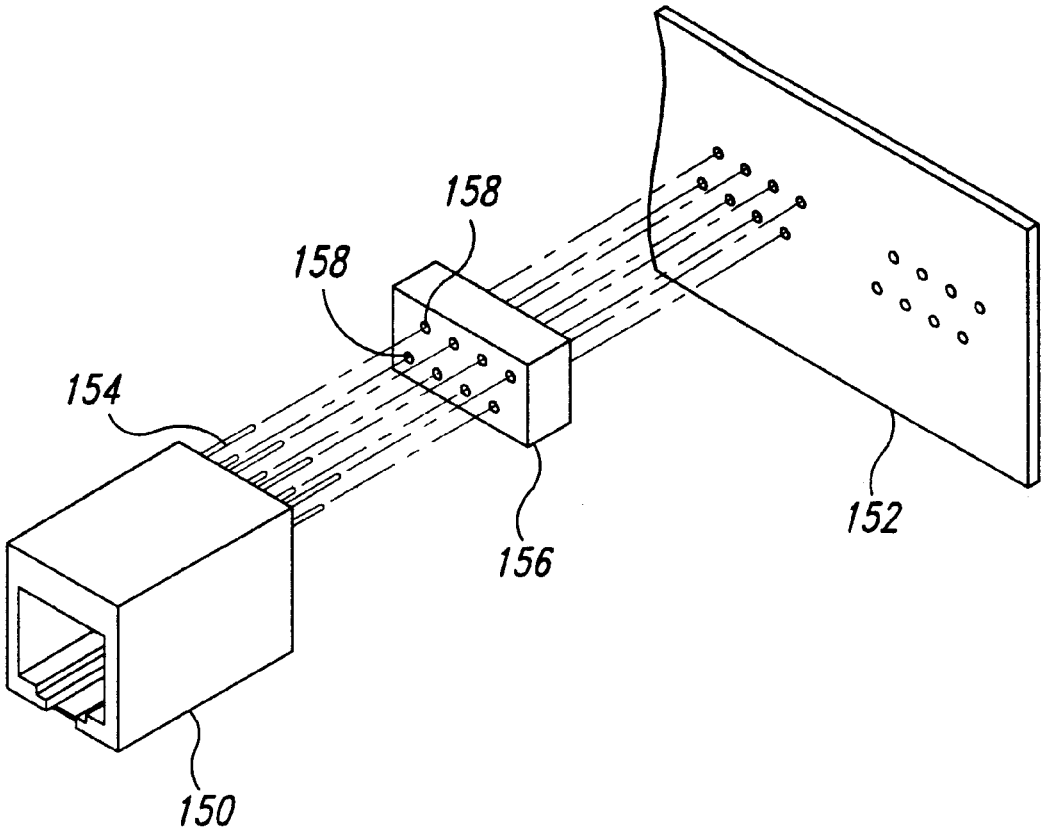
FIG. 9 is an exploded isometric view of an alternative embodiment of a telecommunications connector constructed in accordance with the present invention.
Figure 7:
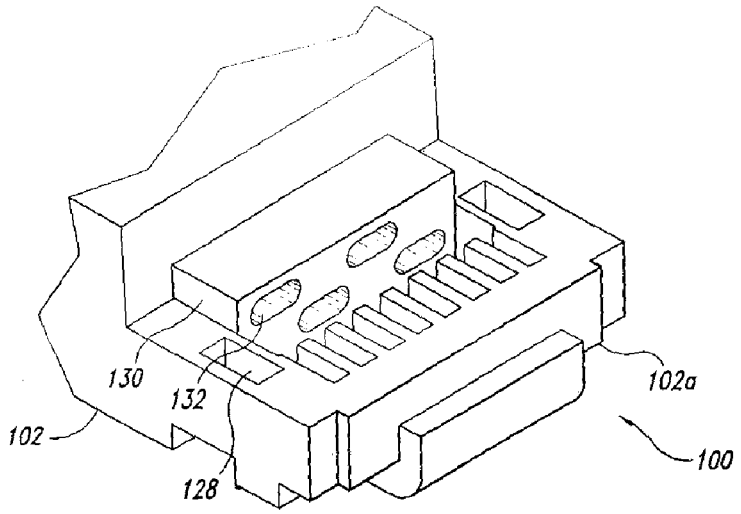
Figure 8:
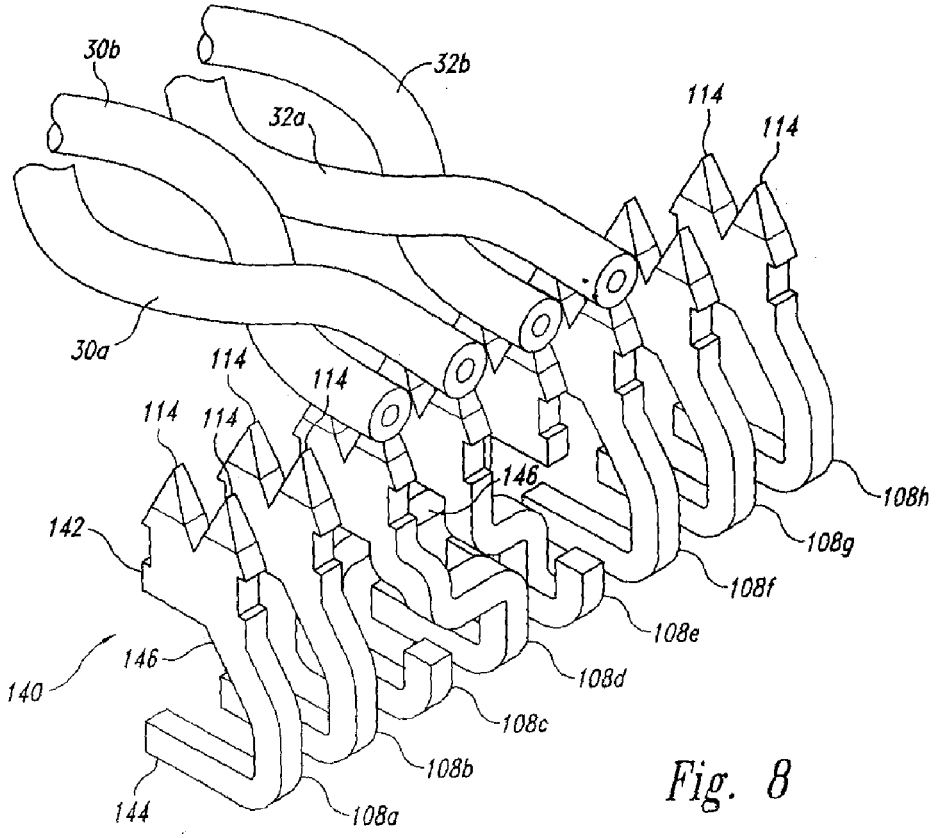

The present invention is directed to an improvement in telecommunications adapters/connectors that reduces the crosstalk between conductors within the body of the adapter. The present invention, illustrated in the exemplary embodiment of FIG. 4, includes a telecommunications adapter or connector 100 having an elongated main body 102 with an external configuration that conforms to a industry standard telecommunications connector. In the exemplary embodiment of FIG. 4, the telecommunications connector 100 conforms to the industry standard specifications for an RJ45 plug. However, as will be discussed below, the principles of the present invention are applicable to other telecommunications connectors. The industry standard external configuration allows the telecommunications connector 100 to readily connect with an industry standard mating receptacle 150, such as shown in FIG. 9. It is noted that the telecommunications connector 100 of the present invention may take the form of a plug or a receptacle, or any other style connector.

A forward first end 102*a* of the main body 102 of the telecommunications connector 100 includes a spring lock tab 104 that functions in a well-known manner to secure the telecommunications connector 100 to the mating receptacle 150 (see FIG. 9). The telecommunications connector 100 also has positioned at its first end 102*a* a contact assembly 106, which includes a plurality of connector elements 108. A rearward second end 102*b* of the main body 102 includes an interior compartment 110 (see FIG. 6) with a rearward facing aperture 112 sized to receive the cable 36 (see FIG. 1B).

Figure 5:
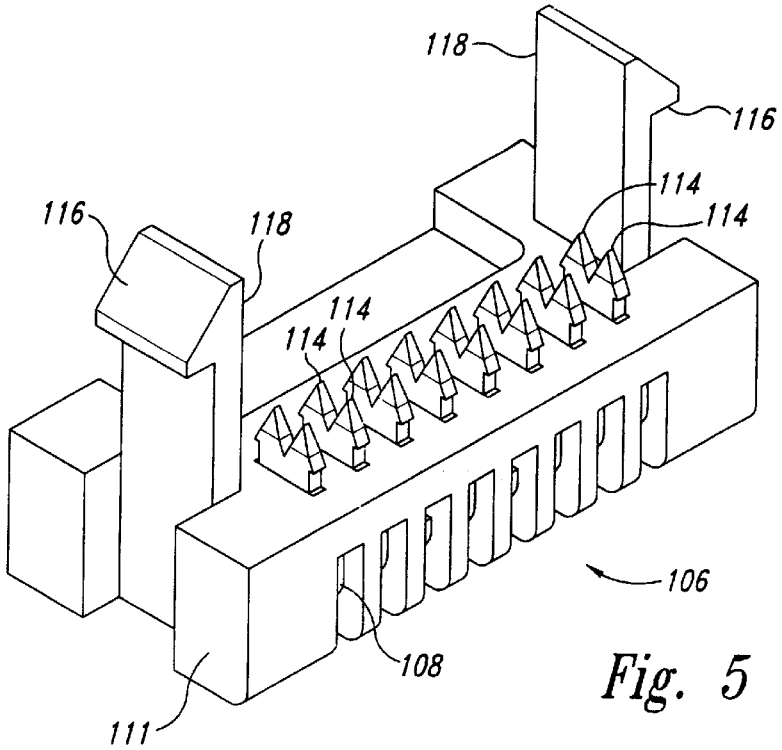
FIG. 5 is a top perspective view of a contact assembly of the telecommunications connector of FIG. 4.

Details of the contact assembly 106 are provided in FIG. 5. The contact assembly 106 has a body portion 111 preferably manufactured from a material, such as polymethyl pentene, which has a dielectric constant of approximately 2.0. Alternatively, the contact assembly 106 may be manufactured from any suitable material having a dielectric constant less than 3.0. The connector elements 108 are embedded within the low dielectric body portion 111 of the contact assembly 106. The use of a low dielectric material for the body 111 of the contact assembly 106 results in a significant decrease in the capacitance between the connector elements 108 when compared to a similar design made from polycarbonate material, which has a dielectric constant of approximately 3.6.

Each connector element 108 includes a pair of pointed contact members 114 which extend from the body 111 of the contact assembly 106. The pointed contact members 114 are designed to pierce the insulating cover surrounding a corresponding one of the electrical conductors of the cable 36 and make electrical contact with the wire therein. However, as can be readily appreciated by those of ordinary skill in the art, other configurations are acceptable to establish electrical contact between the connector elements 108 and the individual electrical wires of the cable 36.

The contact assembly 106 also includes resilient locking flanges 116 mounted atop posts 118 extending from the body 111 of the contact assembly in the same direction as the pointed contact members 114*a* and 114*b*. In operation, a conventional crimping tool (not shown) affixes the cable 36 to the pointed contact members 114 of each connector element 108. The contact assembly 106 is then fastened to the main body 102 of the telecommunication connector 100 by inserting the posts 118 and locking flanges 116 through a pair of mounting holes 120 in the main body 102.

Figure 6:
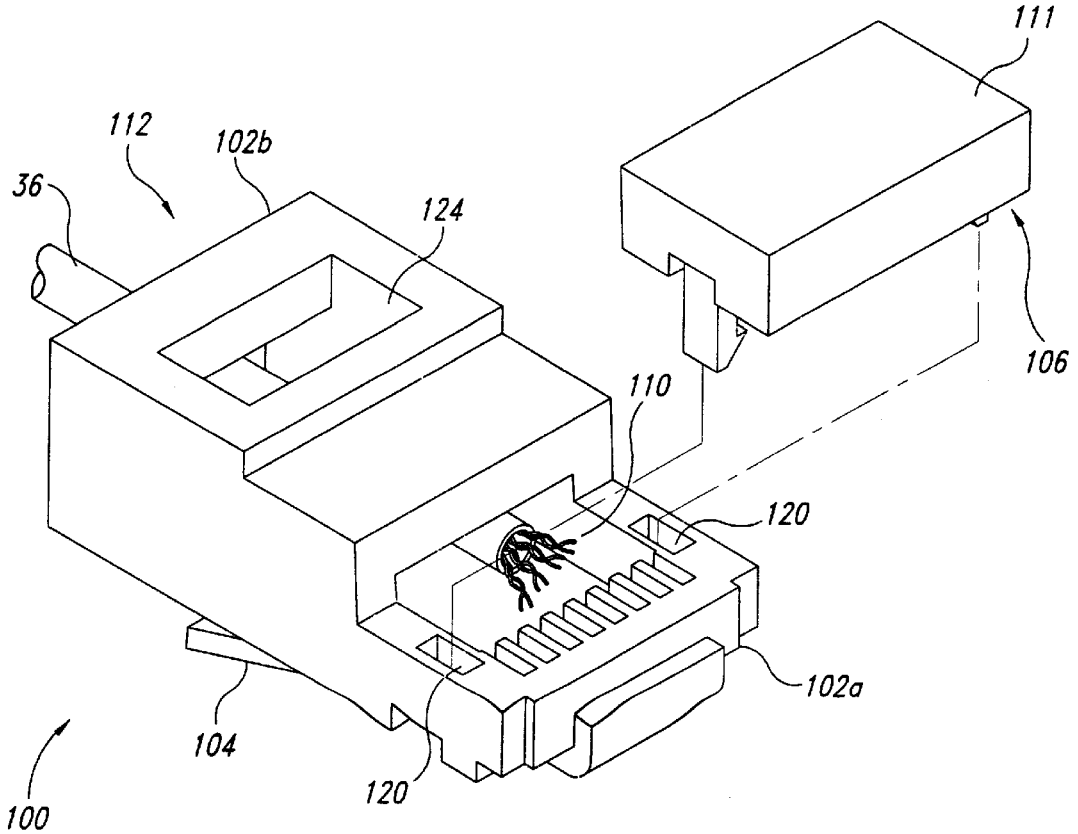
FIG. 6 is a bottom perspective view of the telecommunications connector of FIG. 4.

FIG. 6 is an exploded bottom perspective view of the main body 102 of the telecommunications connector 100 without the contact assembly 106 mounted thereto. A strain relief 124 operates in a known fashion to retain the cable 36 within the aperture 112. The user installs the telecommunications connector 100 by inserting the cable 36 through the aperture 112 in the rear 102*b* of the telecommunications connector. The cable 36 is drawn through the interior compartment 110 and is typically attached to the contact assembly 106 using a conventional crimping tool. As will be described below, one advantage of the present invention is that the twisted pair cables 30–34 of the cable 36 can be maintained in their twisted pair configuration right up to the point of connection at the contact assembly 106. As previously discussed, the conventional telecommunications connector 40 (see FIG. 2) requires that the individual wires 32*a* and 32*b* be untwisted within the body of the telecommunications connector to accommodate connection to the connector elements 42. The individual wires 30*a* and 30*b* are thus differentially exposed in the conventional telecommunications connector 40 to crosstalk from other untwisted wires of the twisted pair cable 32 as well as other wires in the cable 36. The telecommunications connector 100 of the present invention overcomes this disadvantage by allowing the twisted pair cable 32 to remain in a twisted configuration as they pass through the interior compartment 110 of the main body 111 at least up to the very point of connection to the contact assembly 106, thus minimizing differential signals on the twisted pair cables. Other aspects of the construction of the contact assembly 106 which will be discussed in greater detail below also add to reduced crosstalk.

Following the connection of the cable 36 to the contact assembly 106, using crimping or other conventional techniques, the contact assembly is attached to the main body 102 of the telecommunications connector 100. The posts 118 are inserted into the mounting holes 120 in the main body 102 of the telecommunications connector 100 and pressed down until the locking flanges 116 snap into place to releasably retain the contact assembly 106 attached to the main body 102. At that time, the strain relief 124 is also snapped into place to retain the cable 36 firmly in position within the main body 102 of the telecommunications connector 100.

Figure 7:
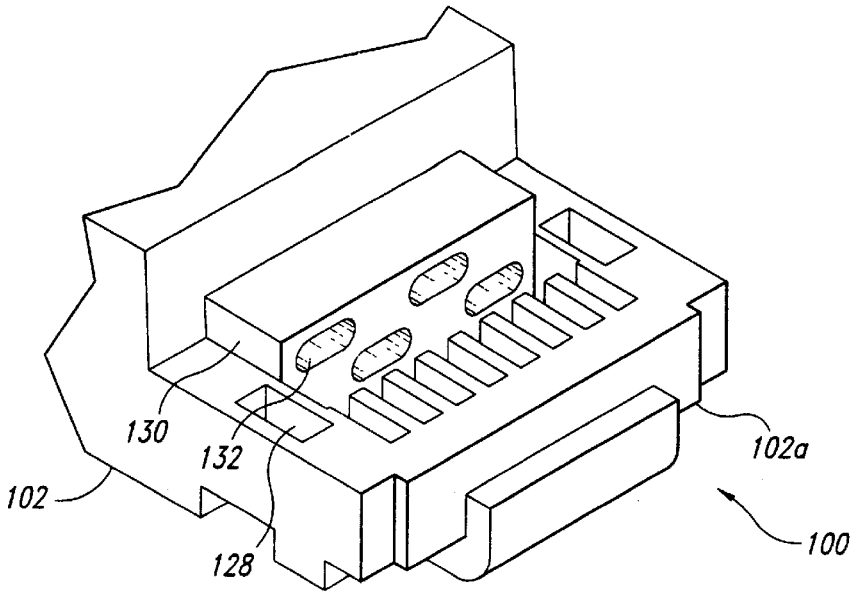
FIG. 7 is an enlarged fragmentary view of an alternative embodiment of the telecommunications connector of FIG. 6 illustrating the addition of optional components.

In an alternative embodiment of the telecommunications connector 100 illustrated in FIG. 7, a ferrite block 130 may be inserted into the interior compartment 110 to reduce crosstalk between individual wires connected to the connector elements 108 of the contact assembly 106 as the wires pass within the main body 102. The ferrite block 130 contains four passageways 132 disposed in general alignment with a longitudinal axis of the main body 102. The number of passageways 132 used is determined by the number of twisted pair cables to be used with the telecommunications connector 100. In operation, the twisted pair cables are each inserted through a different one of the passageways 116 and attached to the connector elements 108 in a conventional fashion to provide an electrical connection between each wire of a cable and a corresponding one of the connector elements.

The ferrite block 130 serves to increase the mutual inductance between the individual wires of the respective twisted pair cables in each of the passageways 132. At the same time, there is no increase in the mutual inductance between the wires of one twisted pair cable with respect to the wires of any of the other twisted pairs cables within the ferrite block 130. The increase in mutual inductance described above has the effect of decreasing the differential mode impedance for the individual wires for each of the respective twisted pair cables while also causing the common mode impedance to be very high. The low differential mode impedance allows the differential signal of the individual wires of each respective twisted pair cable to be readily amplified by the differential line receivers (see FIG. 1B). The high common mode impedance reduces the coupling of signal from one twisted pair cable to the other twisted pair cables. Thus, the ferrite block 130 alters the effective coupling between individual wires of each twisted pair cable and between the individual twisted pair cables themselves. This alteration of mutual inductance may be considered a form of electromagnetic shielding between the wires in different passageways, thereby reducing crosstalk between these wires.

In an exemplary embodiment, the ferrite block 130 is manufactured from material number 61 manufactured by Fair-Rite Corporation. This material has an initial permeability $\mu_{INIT}$=125. The permeability at 50 MHz is $\mu_{50\ MHz}$=100. The loss factor for material number 61 is $4\times10^{-3}$ at 50 MHz. The selection of ferrite materials may be optimized for operation at selected frequencies to further decrease crosstalk between the electrical conductors.

Figure 8:
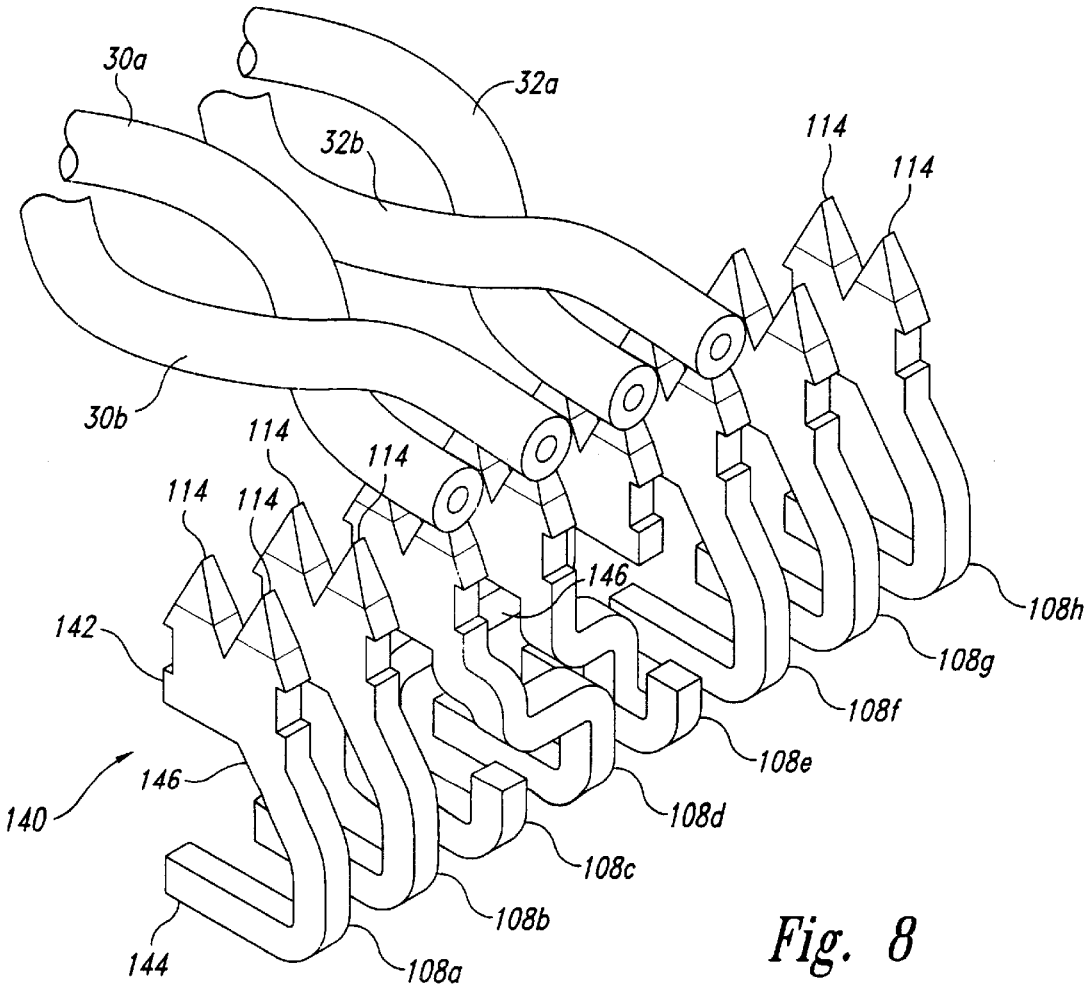
FIG. 8 is a perspective view of the connector elements shown removed from the contact assembly of FIG. 5.

In addition to reducing crosstalk by keeping the wires of the twisted pair cables in a twisted configuration and through the use of the optional ferrite block 130, the telecommunications connector 100 improves performance by altering the geometry of the connector elements 108 themselves. FIG. 3 illustrates the geometry of conventional connector elements 42, which have a large surface area thus increasing the capacitance between the individual ones of the connector elements. In contrast, the geometry of the connector elements 108 of the telecommunications connector 100 significantly reduces their crosssectional surface area and thus reduces the capacitance. FIG. 8 illustrates the connector elements 108 of the present invention removed from the body 111 of the contact assembly 106. The bare connector elements 108 form a wire lead frame 140 comprising multiple ones of the connector elements. The wire lead frame 140 in the example of FIG. 8 is used for the industry standard RJ45 plug, which includes eight connector elements 108*a* to 108*h*. Each of the connector elements 108*a*–108*h* includes a connection portion 142 with the pointed contact members 114 for making electrical contact with a corresponding wire of one of the twisted pair electrical conductors, a terminating portion 144 for making electrical contact with the mating connector 150 (see FIG. 9) when the telecommunications connector 100 is coupled to the mating connector, and a narrow, low surface area profile intermediate portion 146 providing electrical connection between the connection portion and the terminating portion. The connector portions 142 are arranged in spaced-apart parallel relation with each other, and the terminating portions 144 are arranged in spaced-apart parallel relation with each other, with the connection and terminating portions arranged in a row or sequences extending laterally, generally transverse to the longitudinal axis of the main body 102 of telecommunications connector 100 when the contact assembly 106 is attached thereto.

The connection portion 142 of the connector elements 108*a*–108*h* includes the pointed contact members 114, which are designed to pierce the insulating cover on the electrical wires of the cable 36 using a conventional crimping tool. The connection portion 142 has sufficient strength and rigidity for use in crimping corresponding conductors of the twisted pair cables of the cable 36 to the connector elements 108*a*–108*h*. As previously discussed, other known techniques may also be used to provide the necessary electrical contact between the wires of the cable 36 and the connector elements 108*a*–108*h*. Accordingly, the present invention is not limited by the specific form used to interconnect the cable 36 and the connector elements 108*a*–108*h*. In addition, the present invention may be used with any number of twisted pair cables as well as other plugs and mating connectors.

The terminating portions 144 of connector elements 108*a*–108*h* are configured with size and spacing appropriate for the particular application. In the example of an RJ45 connector, the terminating portions 144 of the connector elements 108*a*–108*h* have an elongated bar shape designed to provide electrical contact with an industry standard mating receptacle 150 (see FIG. 9) in a known fashion when inserted therein.

The intermediate portion 146 of each of the connector elements 108*a*–108*h* is a curved elongated conductor having a cross-sectional area substantially equal to the cross-sectional area of the bar shaped terminating portion 144. This is to be compared with the conventional connector elements 42 (see FIG. 3) where the connection portion 142, terminating portion 144 and intermediate portion 146 of each of the connector elements 108*a*–108*h* of the present invention take the form of a flat, large surface area plate. This is especially so for the intermediate portion 146 which in the present invention has a narrow, significantly reduced surface area. The conventional connector element 42 (see FIG. 3) is fabricated as a solid flat piece extending between the contact surface 44 and the terminal surface 46. In contrast, the connection portion 142 and the terminating portion 144 of each connector element 108 of the present invention define a total area therebetween (i.e., the area over which the flat plate intermediate portion of prior art connector elements extend), but the intermediate portion 146 of the present invention extending therebetween has a cross-sectional area that is significantly less than the total area. Thus, the design of the connector elements 108*a*–108*h* reduces the area of the connector element itself. As previously discussed, the decreased area reduces the effective capacitance between individual ones of the connector elements 108*a*–108*h*. In addition, the use of polymethyl pentene material for the body 111 of the contact assembly 106 effectively reduces the dielectric constant and thus further reduces the capacitance between individual ones of the connector elements when compared with the conventional telecommunications connector 40.

In the conventional telecommunications connector 40 (see FIG. 2) the wires 30*a* and 30*b* are connected to the innermost connector elements 42 of the telecommunications connector and the wires 32*a* and 32*b* of the twisted pair cable 32 are required to be separated and coupled to connector elements on opposite sides of the innermost connector elements to which the wires 30*a* and 30*b* are connected. This located the wires 30*a* and 30*b* intermediate the wires 32*a* and 32*b*. As previously discussed, such an arrangement can result in to significant crosstalk between the twisted pair cables 30 and 32.

In contrast, the telecommunications connector 100 of the present invention does not require untwisting of the wires 32*a* and 32*b* of the twisted pair cable 32 prior to connection to the contact assembly 106 (see FIGS. 5 and 6). As such, the twisted pair cable 32 can be maintained in its twisted pair configuration for its full passage through the interior compartment 110 of the telecommunications connector 100 right up to the point of connection to the contact assembly 106. This is possible by positioning the terminating portions 144 of the contact elements 108*a*–108*h* in the arrangement necessary to match the contact arrangement of the standard mating receptacle 150 to which connected, and positioning the connection portions 142 of the contact elements in arrangement with the twisted pair cables of the cable 36 so that the connector portions 142 to which the pair of wires of each twisted pair cable are connected are immediately adjacent to each other. Thus, while the contact arrangement for the terminating portions must be such that the signals of wires 30*a*, 30*b*, 32*a* and 32*b* are presented in the sequence 32*b*, 30*b*, 30*a*, then 32*a*, the twisted pair cables 30 and 32 may be maintained in their twisted pair configurations and the wires thereof connected to the connection portions 142 in the sequence 30*b*, 30*a*, 32*b*, 32*a* (with both wires of cable 32 immediately adjacent to each other, and both wires of cable 30 immediately adjacent to each other). No untwisting of the wires is required to achieve proper alignment with the conventional connector elements 42, as shown in FIG. 3. This is achieved with the connector elements 108 of the present invention allowing the connector portions 142 to be arranged to match the untwisted positions of the wires of the twisted pair cables, and the terminating portions 144 to be arranged to match the positions of the standard mating receptacle 150, even though this requires the connector portion and the terminating portion of a particular connector element 108 (such as connector elements 108*c*, 108*d* and 108*e*) to be in a non-planar arrangement. This nonplanar arrangement is possible by extending the intermediate portion 146 laterally between the connector portion 142 and the terminating portion 144 of a non-planar arranged connector element. With conventional connector elements 42 shown in FIG. 3, the planar design required the connector and terminating portions thereof (contact surface 44 and terminating surface 46, respectively) to be arranged parallel and hence the wires of the twisted pair cables 30 and 32 to be untwisted as shown in FIG. 2.

With the present invention, the wires 32*a* and 32*b* are coupled to the pointed contact members 114 of immediately adjacent connector portions 142 of contact elements 108*f* and 108*c*, respectively. The wire 32*a* is coupled to the connector portion 142 of the connector element 108*f*. The connector portion 142 of the connector element 108*c* is positioned immediately adjacent and has the wire 32*b* coupled thereto. Thus, the wires 32*a* and 32*b* of the twisted pair cable 32 are coupled to the pointed contact members 114 of immediately adjacent connector portions 142 and remain in their twisted pair configuration throughout substantially the entire length of the main body 102 of the telecommunications connector 100 (see FIG. 6). As previously noted, crosstalk is reduced by keeping the wires in a twisted pair configuration as much as possible.

The wire 30*a* is coupled to the connector portion 142 of the connector element 108*e*, while the wire 30*b* is coupled to the immediately adjacent connector portions 142 of the connector element 108*d*. As illustrated in FIG. 8, intermediate portions 146 of the connector elements 108*c*–108*e* pass laterally by each other within the body 111 of the contact assembly 106 (see FIG. 6) as necessary to connect with the non-planar located terminating portion 144 corresponding thereto. The intermediate portions 146 of the connector elements 108*c*–108*e* pass by each other so that the terminating portions 144 of the connector elements 108*a*–108*h* carry the correct signals from each of the wires of the twisted pair cable 36 in order to conform with industry standards.

The conventional telecommunications connector 40 has a one-to-one planar correspondence in the sequence of the contact surface 44 of the connector elements 42 with the sequence of the corresponding terminal surface 46. That is, the lateral location sequence of the connector surface 44 for the connector elements (see FIG. 3) identically matches the lateral location sequence of the terminating surface 46 of the connector elements. This matching spatial arrangement forces the untwisting of at least the wires 32*a* and 32*b* of the twisted pair cable 32 in order to connect them in accordance with the industry standard.

In contrast, the connector portions 142 of the connector elements 108*a*–108*h* of the present invention (and hence the wire arrangement) need not have the same sequential arrangement as the terminating portions 144 of the connector elements. For the illustrated embodiment of the invention described above, the intermediate portion 146 of the connector element 108*c* allows the sequence to be altered by connecting the signal from the wire 32*b* at one lateral location to the terminating portion 144 at a different lateral location dictated by industry standards to achieve the proper physical alignment on the terminating portions 144 of the connector elements 108*a*–108*h*. Similarly, the intermediate portions 146 of the connector elements 108*d* and 108*e* allow the conventional wire and connector portion sequence to be changed so that the wires 30*a* and 30*b* remain immediately adjacent to each other while still satisfying the industry standard locations for the terminating portions 144 thereof to be positioned intermediate the terminating portions 144 of the connector elements 108d and 108*e* and carry the signals from the wires 30*a* and 30*b*. This arrangement provides the signals carried on the wires 32*a* and 32*b* are terminating portions 144 on opposite sides of the terminating portions carrying the signals on the wires 30*a* and 30*b*. Thus, the industry standard configuration is maintained at the terminating portion 144 of the connector elements 108*a*–108*h* while the wires of twisted pair cables are all coupled to immediately adjacent connector portions 142, thus eliminating the need to untwist the wires as they pass through the interior compartment 110 of the telecommunications connector 100. By keeping the wires 32*a* and 32*b* of the twisted pair cable 32 in the illustrated embodiment in a twisted pair configuration for a longer length, crosstalk is reduced.

In a preferred embodiment, the intermediate portion 146 of the connector element 108*c* crosses by the connector elements 108*d* and 108*e* at right angles to the connector and terminating portions 142 and 144 thereof so as to minimize the coupling between the signals carried on the respective connector elements. Although the configuration illustrated in FIG. 8 may result in a moderate increase in crosstalk caused by the proximity of the intermediate portions 146 of the connector elements 108*c*–108*e*, the overall performance of the telecommunications connector 100 is improved because the twisted pair cables remain in twisted configuration for a longer length than in the conventional telecommunications connector 40. In addition, the effects of crosstalk are reduced by effectively reducing the area in the connector elements 108*a*–108*h* compared to the conventional connector element 42 (see FIG. 3), thereby reducing the capacitance between individual ones of the connector elements. The crosstalk is further reduced by the use of polymethyl pentene material used for the body 111 of the contact assembly 106 (see FIG. 6).

In addition, the crosstalk between individual ones of the connector elements 108*a*–108*h* is highly predictable because the spacing and configuration of the connector elements is fixed. This also provides an advantage over the conventional telecommunications connector 40 in which the untwisting of the wires of the twisted pair cable 32, which varies from one assembled connector to the next, results in an unpredictable coupling between signals on the twisted pair cables 30–34. Given the highly predictable coupling characteristics of the telecommunications connector 100, it is possible to design compensation circuits to compensate for crosstalk. The compensation circuits may also be designed for operation at particular frequencies. In an exemplary embodiment, the compensation circuits (not shown) can be incorporated into the line drivers 18–22 (see FIG. 1B) and receivers 24–28 to compensate for known capacitive effects at the frequency of operation. For example, given the specific capacitive characteristics of the telecommunications connector 100, it is possible to design a compensation circuit for operation at 100 megahertz. The design and use of such compensation circuits is well known in the art and will not be described herein.

The principles of the present invention have been described with respect to the example of an RJ45 plug. However, the principles of the present invention are readily extendible to other forms of connectors, such as to the standard RJ45 jack 150 illustrated in FIG. 9. The RJ45 jack 150 is configured to mount on a printed circuit (PC) board 152. As illustrated in FIG. 9, the RJ45 jack 150 includes a plurality of electrical conductors 154. In accordance with the invention the conductors 154 may be mounted in a polymethyl pentene material, or other material having a sufficiently low dielectric constant. In addition, the electrical conductors 154 may include intermediate portions (not shown) that pass by each other in order to alter the sequential arrangement of the electrical conductors as described above for the intermediate portions 146. An optional ferrite block 156 may be used which contains a series of passageways 158 configured to accommodate the electrical conductors 154. The ferrite block 156 is mounted intermediate the RJ45 jack 150 and the PC board 152 with the electrical conductors 154 extending fully through the passageways 158 and electrically connected to the PC board 152.

It should also be noted that the RJ45 jack 150 may be available in a wall mount version with twisted pair cables being coupled directly to the RJ45 jack. The principles of the present invention are intended to encompass all such variations of telecommunications connectors. In addition, the present invention is intended to encompass telecommunications connectors other than the RJ45, and may include a greater or lesser number of twisted pair cables. Thus, the present invention set forth in the accompanying exemplary embodiments reduces crosstalk between connector elements by reducing the area of the connector elements themselves, embedding the connector elements in a low dielectric material, and altering the sequential arrangement of the connector elements so as to permit the twisted pair configuration to exist for a maximum possible length within the connector body.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A telecommunications connector assembly coupleable to a mating connector, the connector assembly comprising:

a body having first and second end portions along a longitudinal axis of said body, said first end portion being configured to mate with the mating connector;

an electrical cable extending within said body from said second end portion to said first end portion, said cable comprising a plurality of twisted pair electrical conductors which remain twisted while within said body until in proximity with said first end portion; and a plurality of connector elements at said body first end portion, each of said plurality of connector elements having a connection portion piercing one conductor of said plurality of twisted pair electrical conductors, a contact portion to make electrical contact with the mating connector when said first end portion is mated to the mating connector, said connection portions being located in a row directly above the contact portions, and an elongated aim extending between and electrically connecting together said connection portion and said contact portion.

2. The connector assembly of claim 1 wherein each of said plurality of twisted pair electrical conductors is covered by an insulating material and said connection portions include a piercing element to pierce said insulating material and thereby establish electrical contact between corresponding ones of said plurality of twisted pair electrical conductors and said connector elements.

3. The connector assembly of claim 1 wherein said plurality of connector elements are at least partially embedded in a material having a dielectric constant less than 2.8, and said connector elements are at least partially surrounded by said material.

4. The connector assembly of claim 1 wherein said plurality of connector elements are at least partially embedded in a polymethyl pentene material, and said connector elements are at least partially surrounded by said material.

5. The connector assembly of claim 1 wherein said connection portions are arranged substantially parallel to each other, said contact portions are arranged substantially parallel to each other, and at least one of said elongated arms extend between one of said connection portions and one of said contact portions which are positioned out of coplanar relation with each other.

6. The connector assembly of claim 5 wherein at least two of said elongated arms cross by each other within said body.

7. The connector assembly of claim 5 wherein said connection portions and said contact portions are arranged in coplanar pairs comprised of one of said connection portions and one of said contact portions.

8. The connector assembly of claim 5 wherein said at least two of said elongated arms cross by each other at a substantially right angle.

9. The connector assembly of claim 1 wherein said body includes a chamber extending longitudinally therewithin said cable extends therethrough, and further including a ferrite member positioned within said chamber and containing a plurality of spaced apart passageways disposed in general alignment with said longitudinal axis and with passageway openings facing towards said first and second end portions, said ferrite member having a ferrite wall portion positioned between individual ones of said passageways, said passageways each being sized to receive and receiving at least one conductor of a different one of said twisted pair conductors.

10. The connector assembly of claim 1 wherein said body conforms to industry standards for an RJ45 plug.

11. The connector assembly of claim 1 wherein said body conforms to industry standards for an RJ45 jack.

12. A telecommunications connector assembly configured to receive a plurality of electrical conductors in an electrical cable and mate with a mating connector, the connector assembly comprising:

a body; and a plurality of connector elements retained by said body, each of said plurality of connector elements having a connection portion for piercing one of the plurality of electrical conductors and a contact portion to make electrical contact with the mating connector when mated to the mating connector, said connection portion and said contact portion defining an intermediate area therebetween,said connection portions being located in a row directly above the contact portions, each of said connector elements further includes an intermediate portion extending between and electrically connecting together said connection portion and said contact portion, said intermediate portion occupying an area between said connection portion and contact portion less than said intermediate area.

13. The connector assembly of claim 12 wherein each of the plurality of electrical conductors is covered by an insulating material and said connection portions include a piercing element to pierce the insulating material and thereby establish electrical contact between corresponding ones of the plurality of electrical conductors and said connector elements.

14. The connector assembly of claim 12 wherein at least a portion of said body is made with a material having a dielectric constant less than 2.8, and said connector elements are at least partially surrounded by said material.

15. The connector assembly of claim 12 wherein at least a portion of said body is made with a polymethyl pentene material, and said connector elements are at least partially surrounded by said material.

16. The connector assembly of claim 12 wherein said connection portions are arranged substantially parallel to each other, said contact portions are arranged substantially parallel to each other, and at least one of said intermediate portions extend between one of said connection portions and one of said contact portions which are positioned out of coplanar relation with each other.

17. The connector assembly of claim 16 wherein at least two of said intermediate portions cross by each other within said body.

18. The connector assembly of claim 16 wherein said connection portions and said contact portions are arranged in coplanar pairs comprised of one of said connector portions and one of said contact portions.

19. The connector assembly of claim 18 wherein said at least two of said intermediate portions cross by each other at a substantially right angle.

20. A telecommunications connector assembly configured to receive a plurality of electrical conductors in an electrical cable and mate with a mating connector, the connector assembly comprising:

a body manufactured at least in part from a material have a dielectric constant less than 2.8; and a plurality of connector elements retained by said body at least partially embedded in said dielectric material, each of said plurality of connector elements having a connection portion for contacting one of the plurality of electrical conductors and a contact portion to make electrical contact with the mating connector when mated to the mating connector; wherein said connection portions are arranged substantially parallel to each other, said contact portions are arranged substantially parallel to each other, and at least one of said elongated arms extend between one of said connection portions and one of said contact portions out of coplanar relation with each other; and wherein at least two of said elongated arms cross by each other at a substantially right angle.

21. The connector assembly of claim 20 wherein said body is made with a polymethyl pentene material, and said connector elements are at least partially surrounded by said material.

22. The connector assembly of claim 20 wherein each of said plurality of connector elements includes an elongated arm each of said elongated arms being electrically coupled to said connection portion and to said contact portion therebetween.

23. The connector assembly of claim 20 wherein said connection portions and said contact portions are arranged in coplanar pairs comprised of one of said connector portions and one of said contact portions cross by each other within said body.

24. A telecommunications connector assembly configured to receive a plurality of twisted pair electrical conductors in an electrical cable and mate with a mating connector, the connector assembly comprising:

a body having first and second ends along a longitudinal axis of said body, said first end being configured to mate with the mating connector and said second end adapted to receive the electrical cable; and a plurality of connector elements retained by said body at least partially embedded in said dielectric material, each of said plurality of connector elements being integrally formed from an electrically conductive material and having a connection portion for piercing one of the plurality of twisted pair electrical conductors, a contact portion to make electrical contact with the mating connector when said first end is mated to the mating connector, said connection portions being located in a row directly above the contact portions, and a rigid intermediate portion with at least two of said rigid intermediate portions crossing by each other within said body wherein said connection portions have sequential positions in a first ordered sequence to receive predetermined ones of the plurality of electrical conductors and said contact portions have sequential positions in a second ordered sequence different from said first ordered sequence, ones of said connector and contact portions in differing sequential positions being electrically connected together by said rigid intermediate portions, which cross by each other within said body.

25. The connector assembly of claim 24 wherein said body is made with a material having a dielectric constant less than 2.8, and said connector elements are at least partially surrounded by said material.

26. The connector assembly of claim 24 wherein said body is made with a polymethyl pentene material, and said connector elements are at least partially surrounded by said material.

27. The connector assembly of claim 24 wherein said at least two rigid intermediate portions cross by each other at a substantially right angle.

28. A telecommunications connector assembly configured to receive at least two pairs of twisted pair electrical conductors in an electrical cable and mate with a mating connector, the connector assembly comprising:

a body having first and second end portions along a longitudinal axis of said body, said first end portion being configured to mate with the mating connector and said second end portion being adapted to receive the electrical cable; and first, second, third and fourth rigid integrally formed electrical connector elements including first, second, third, and fourth sequentially arranged connection portions, respectively, said first and second connection portions being mounted within said body to contact first and second electrical conductors, respectively, of a first one of the twisted pair electrical conductors, and said third and fourth connection portions being mounted within said body to contact first and second electrical conductors, respectively, of a second one of the twisted pair electrical conductors, said first, second, third and fourth rigid integrally formed electrical connector elements also including first, second, third, and fourth sequential arranged contact portions, respectively, to make electrical contact with the mating connector when said first end portion is mated to the mating connector and first, second, third, and fourth intermediate portions extending and providing an electrical connection between certain ones of said connection portions and said contact portions, said first intermediate portion providing an electrical connection between said first connection portion and said second contact portion, said second contact portion providing an electrical connection between said second connection portion and said third contact portion, said third intermediate portion providing an electrical connection between said third connection portion and said first contact portion, and said fourth intermediate portion providing an electrical connection between said fourth connection portion and said fourth contact portion.

29. The connector assembly of claim 28 wherein said body is made with a material having a dielectric constant less than 2.8, and said connector elements are at least partially surrounded by said material.

30. The connector assembly of claim 28 wherein said body is made with a polymethyl pentene material, and said connector elements are at least partially surrounded by said material.

31. The connector assembly of claim 28 wherein said connection portions are arranged substantially parallel to each other, and said contact portions are arranged substantially parallel to each other, and said first, second, and third intermediate portions pass by each other within said body.

32. The connector assembly of claim 31 wherein said first, second, and third intermediate portions pass by each other at a substantially right angle.

* * * * *

UNITED STATES PATENT AND TRADEMARK OFFICE

CERTIFICATE OF CORRECTION

PATENT NO. : 6,007,368
DATED : December 28, 1999
INVENTOR(S) : Alan S. Lorenz et al.

It is certified that error appears in the above-identified patent and that said Letters Patent is hereby corrected as shown below:

Drawings,
Sheet 4, Figure 8 should be revised to correct mislabeled reference numbers as per attached corrected drawing.

Column 15,
Line 20, "said second contact portion" should read -- said second intermediate portion --.

Signed and Sealed this

Fifth Day of April, 2005

JON W. DUDAS
*Director of the United States Patent and Trademark Office*